US005707221A

United States Patent [19]

Wittrisch

[11] Patent Number: 5,707,221

[45] Date of Patent: Jan. 13, 1998

[54] METHOD OF PLURAL ZONE PUMPING UTILIZING CONTROLLED INDIVIDUAL PUMP INLET IN EACH ZONE

[75] Inventor: Christian Wittrisch, Rueil Malmaison, France

[73] Assignee: Institit Francais du Petrole, Rueil Malmaison, France

[21] Appl. No.: 461,739

[22] Filed: Jun. 5, 1995

Related U.S. Application Data

[62] Division of Ser. No. 219,340, Mar. 28, 1994, Pat. No. 5,447,416.

[30] Foreign Application Priority Data

Mar. 29, 1993 [FR] France ..... 93 03714

[51] Int. Cl.[6] ..... F04B 21/00

[52] U.S. Cl. ..... 417/442; 417/503; 166/313

[58] Field of Search ..... 417/503, 442; 166/313

[56] References Cited

U.S. PATENT DOCUMENTS

| | | | |
|---|---|---|---|
| 961,820 | 6/1910 | Waitz | 417/503 |
| 2,118,539 | 6/1938 | Scheider et al. . | |
| 2,752,855 | 7/1956 | Greene . | |
| 3,326,292 | 6/1967 | Young et al. | 166/313 |
| 3,559,740 | 2/1971 | Scaggs . | |
| 3,680,637 | 8/1972 | Raulins | 166/313 |
| 3,765,483 | 10/1973 | Vencil | 166/313 |
| 4,013,385 | 3/1977 | Peterson . | |
| 4,815,791 | 3/1989 | Schmidt et al. . | |
| 5,145,004 | 9/1992 | Cornette . | |
| 5,335,732 | 8/1994 | McIntyre | 166/313 |

FOREIGN PATENT DOCUMENTS 2176649 11/1973 France .

*Primary Examiner*—Charles G. Freay
*Attorney, Agent, or Firm*—Millen, White, Zelano, & Branigan, P.C.

[57] ABSTRACT

The present invention relates to a pumping method utilizing two suction inlet holes spaced a predetermined distance apart by an extension robe. In a variant, the pumping method utilizes two pump barrels cooperating each with the two inlet holes. In another variant, the pumping method utilizes a pump barrel and control for controlling the flow rates of effluents coming from the two inlet holes. Application of the method is preferable when pumping effluent from subhorizontal drain holes.

10 Claims, 3 Drawing Sheets

METHOD OF PLURAL ZONE PUMPING UTILIZING CONTROLLED INDIVIDUAL PUMP INLET IN EACH ZONE

This is a division of the application Ser. No. 08/219,340 filed Mar. 28, 1994, now U.S. Pat. No. 5,447,416.

FIELD OF THE INVENTION

The present invention relates to a method and to a device for optimizing the pumping of a fluid flowing from a geologic formation into a drain hole extending from a wall. The device includes pumping means having at least two suction inlet holes allowing the effluent to be drawn off in at least two different zones on the length of the drain hole.

The term drain hole which is used here refers to a well drilled so as to cross at least one geologic layer producing an effluent which flows and is collected through said well or drain hole. The drain hole may cross several independant producing layers or not, it may be cased or not, and in the first case, the casing may be cemented and then perforated or preperforated.

BACKGROUND OF THE INVENTION

Conventional pumping methods consist in setting in a well a pump plunged in the effluent produced by a geologic formation crossed by a drain hole drilled from the well. The single effluent suction point is located substantially in the vicinity of the pump. The pump delivers the effluent towards the surface by means of a tubular pipe connecting the pump to the surface. The pump is either electrically driven, and in this case, a cable lowered into the well with the pump provides the pump motor with electric power, or mechanically driven through pumping rods driven from the surface by a longitudinal reciprocating or rotational motion. The pump may be of the reciprocating piston type or a rotary pump, for example of the "MOINEAU" type.

In case the drain hole crosses the layers producing the effluent over a great length, for example when the drain hole is substantially horizontal in the geologic reservoir, the pressure drops due to the flow over a great length of the drain hole may become quite significant. In this case, the conventional method tends to develop less efficiently the drain hole zones which are at the furthest distance from the suction inlet of the pump. Furthermore, when the drain hole crosses layers exhibiting permeability and/or effluent composition heterogeneities, the fluids of greater mobility will be produced in preference to the others. In the particular case of water inflows in a zone of the drain hole, the other zones located on the opposite side of the pump with respect to the water inflow zone will be inefficiently developed, if at all. It is the same when the drain hole geometry provides traps for the lighter fluids.

SUMMARY OF THE INVENTION

The object of the present invention is to remedy these drawbacks without requiring complex equipment difficult to implement in an oilwell.

The present invention therefore relates to a device for pumping an effluent flowing through a drain hole drilled through at least one geologic layer forming a reservoir of said effluent. The device includes pumping means comprising at least two suction inlet holes spaced a predetermined distance apart so as to drain two production zones of the drain hole.

The pumping means may include two pumps co-operating each with one of the two suction inlet holes.

The pumping means may include a pump and means for controlling the flow rates of the effluents arriving at the pump through the two suction inlet holes.

In case the device includes two pumps, they may have a common drive, for example rotating rods or rods moving in a reciprocating motion.

The control means may include a valve for regulating the flows coming from the two inlet holes and the valve may be remote controlled.

One of the two suction inlet holes may be located in the vicinity of the pumping means and the other may be placed at the end of a length of pipes secured with the pumping means.

The device may include an annular seal means between said pipe and the wall of said drain hole, adapted for dividing the drain hole into two production zones.

The invention relates to a method for pumping an effluent flowing through a drain hole. In the method, the draw off of the effluent is optimized through pumping means having at least two suction inlet holes and said inlet holes are located in two production zones of the drain hole.

The flow rates of the effluents arriving at the pumping means through said two inlet holes may be controlled.

Control may be steered from the surface according to measurements achieved on the flows of the effluent.

The method and the device according to the invention may be applied for pumping an effluent flowing through a subhorizontal drain hole.

BRIEF DESCRIPTION OF THE DRAWINGS

Other features and advantages of the invention will be clear from reading the description hereafter given by way of non limitative examples, with reference to the accompanying drawings in which.

DESCRIPTION OF THE PREFERRED EMBODIMENTS

Figure 1:
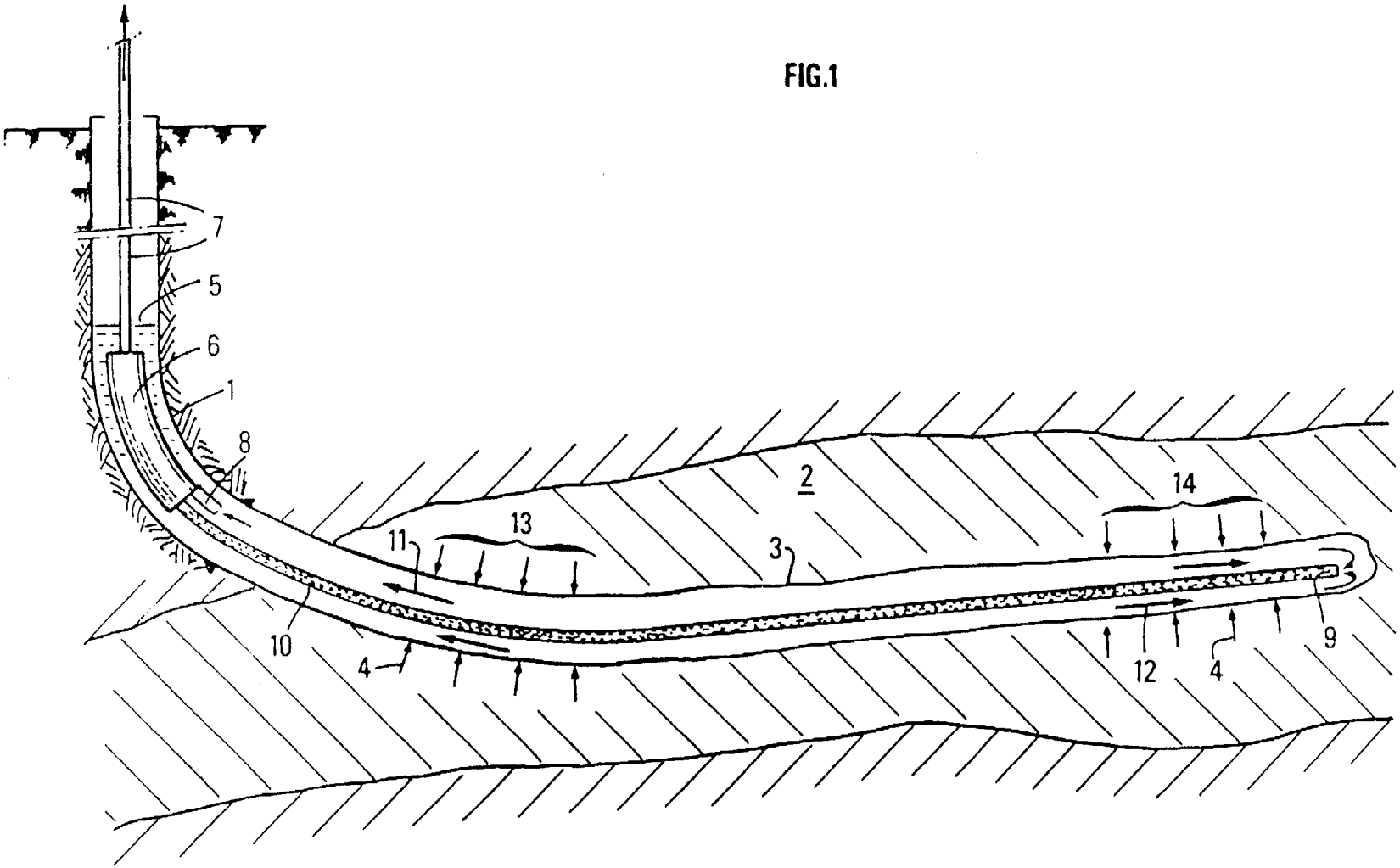
FIG. 1 diagrammatically shows the principle of the invention.

FIG. 1 shows a well 1 drilled from the ground surface. Well 1 is extended through the producing layer 2 by a substantially horizontal drain hole 3. The rock of producing layer 2 contains an effluent to be produced which flows through drain hole 3. These flows are shown here by arrows 4. The level reached by the effluent in well 1 bears reference number 5.

Pumping means 6 are plunged below level 5 so that the suction inlet holes of the pumping means are located and remain in the effluent while the effluent is driven towards the surface by the pumping means.

A pipe 7 connects the pumping means to the surface. Pipe 7 has generally been used for setting and for keeping pumping means 6 in position.

The effluent enters the pumping means through two suction inlet holes 8 and 9. Inlet 8 is located substantially in the vicinity of the pumping means, inlet 9 is preferably located towards the opposite end of the drain hole. An extension tube 10 secured with the pumping means forms a suction pipe. Considering the position of the pumping means, the length of this tube predetermines the position of suction inlet 9 once the pumping means are set in well 1. Of course, suction inlet 8 may also be located a predetermined distance apart from the pumping means by using another extension tube. The distance between the two suction inlets may exceed 50 m and is preferably greater than 100 m, and/or less than 3000 m, preferably less than 2000 m.

Pumping means 6 may include one or two pumps, suction inlets 8 and 9 co-operating in the second case each with a pump. The pump or the pumps preferably deliver the effluent towards the surface through the inside of pipe 7. In case the pumping means include two pumps, they may also comprise separate delivery outlets requiring then two delivery pipes connecting the pumping means to the surface. Two solutions, which are not shown here since they are understandable to the man skilled in the art, may be considered : another string, parallel to string 7, or the setting of a seal means of the packer type between the outside of the barrel of pumping means 6 and the walls of well 1. In the last-mentioned solution, the delivery pipes consist, on the one hand, of string 7 and, on the other hand, of the annular pipe formed by the outside of string 7 and the inside of well 1 above the packer. The two solutions are advantageous in that the pumps may be hydraulically independant, i.e. the flow of the effluent transferred by one pump is totally separate from that transferred by the other pump.

In FIG. 1, arrows 11 show the flow of the effluent coming from the producing zone 13 and flowing towards suction inlet 8, arrows 12 show the flow of the effluent coming from producing zone 14 and flowing towards suction inlet 9.

The drained producing layer is thus divided into two draw off zones supplying respectively suction inlet holes 8 and 9. The position of inlets 8 and 9 in the length of drain hole 3 will be determined notably according to the geometry, the characteristics or the nature of the reservoir effluents.

Figure 2:
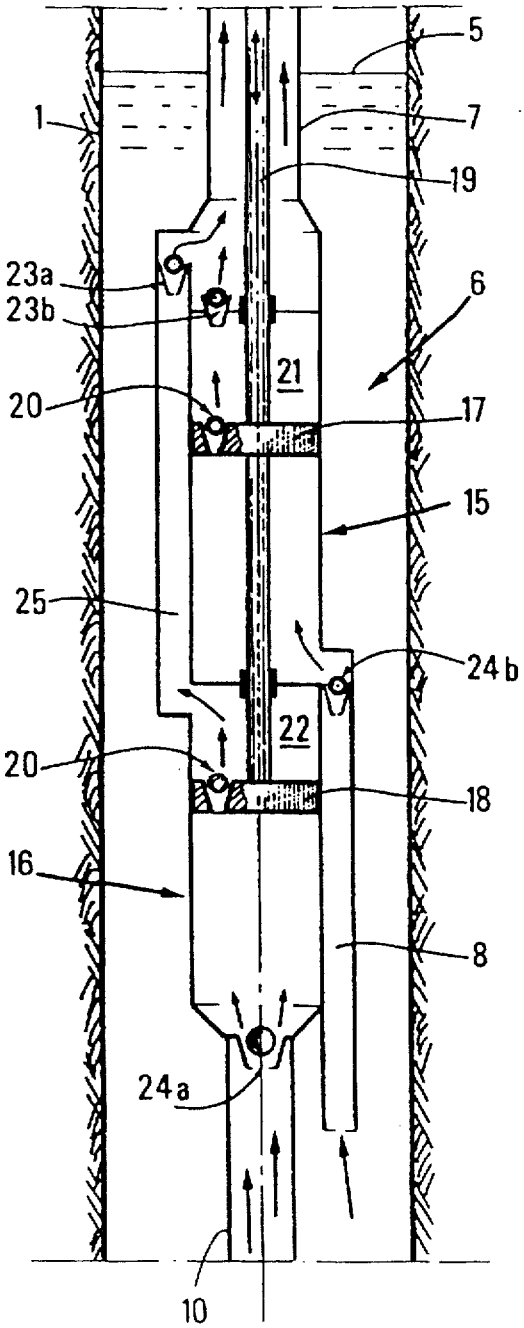
FIG. 2 shows an embodiment according to the invention.

FIG. 2 shows the device according to the invention in which the pumping means 6 include two hydraulically independant pumps which nevertheless have a common drive. The pumps are illustrated here by two piston pump barrels 15 and 16. Pistons 17 and 18, integral with a single rod 19, are moved longitudinally and alternately by pumping rods extending rod 19 up to the surface. An appropriate surface installation, a "horsehead" type mechanical device here, moves the string of pumping rods. The string of rods is located inside string 7.

Clapper valves 20 connected to pistons 17, 18 allow the effluent to flow into each upper chamber 21, 22 of pump barrels 15, 16 during the downward motion of rod 19.

While the rod moves upward, the effluent is delivered from the two chambers 21 and 22 towards the inside of string 7, either substantially directly for chamber 21, or by means of pipe 25 for the lower chamber 22. A set of traveling valves 23*a*, 23*b* and of standing valves 24*a*, 24*b* completes these pumping means.

Inlet 8 is shown here directly on the pump barrel, but a tube may extend the inlet of pump barrel 15 by a certain distance without departing from the scope of the present invention. The suction inlet of pump barrel 16 is located at the other end of extension tube 10.

It is obvious that this variant may be adapted to other pump types, for example rotary pumps of the centrifugal or of the "MOINEAU" type.

Centrifugal pumps are generally driven electrically, which requires a cable link up to the surface. The motorization may be common to the two barrels or independant, which is advantageous in this case since it allows a finer adaptation of the pumping characteristics of each barrel according to the draw off zones by regulating each motorization independantly.

Positive-displacement pumps, for example of the "MOINEAU" type, are generally driven through the rotation of a string of rods driven by a surface installation. The mechanical connection of the rotors of each pump barrel will be adapted to the motion of each rotor by means of a set of knuckle joints.

Figure 3:
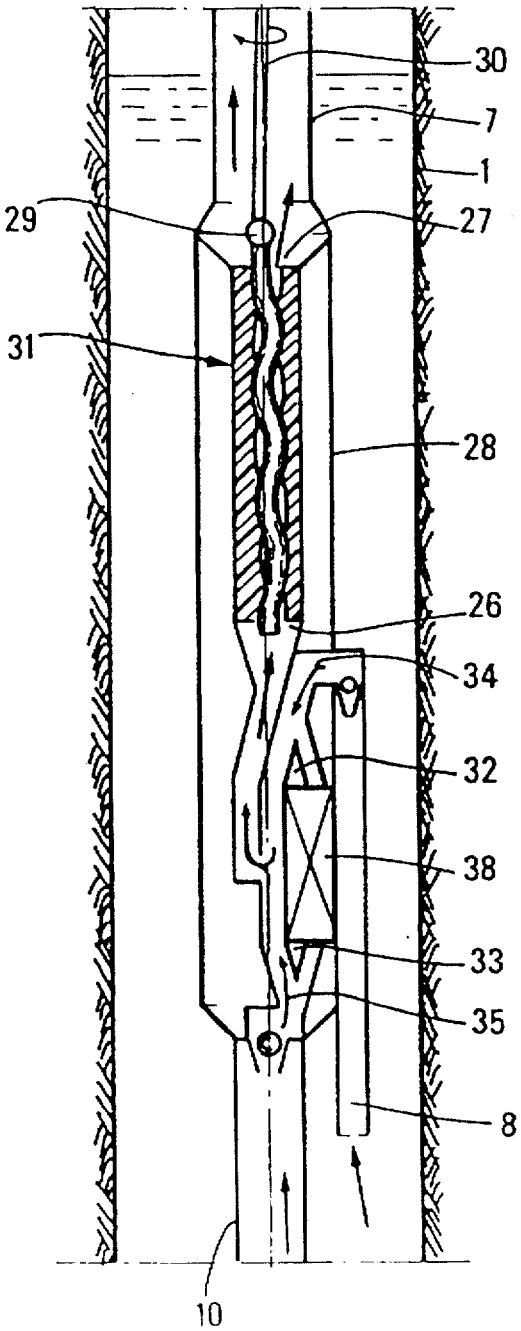
FIG. 3 shows a variant according to the invention.

FIG. 3 shows another variant according to the invention, where the pumping means include a single pump barrel 28 having an inlet 26 and a discharge end 27 for the transferred effluent. A string of rods 30 drives rotor 31 into rotation by means of a knuckle joint 29.

The effluent inlet 26 is supplied at the same time with the effluent drawn through inlet 8 and the effluent coming from the distant inlet at the end of tube 10. The two flows shown by arrows 34 and 35 pass respectively through adjustable-opening valves 32 and 33. Adjustment of these two valves is controlled by control means 38. Remote control of these control means from the surface allows pumping to be optimized by controlling the two flow rates. It is notably possible to totally stop one of the two flows, to balance the value of the flow rates, or to balance the pressure drops at the inlet so as to balance the draw off in the various zones of the drain hole.

Remote control may be transmitted by any means known to the man skilled in the art : pressure or electromagnetic wave, electric, sonic or hydraulic means, optical fiber, etc.

Bottomhole or surface measurings may be achieved in order to help to optimize pumping. It will be particularly interesting to know the dynamic pressures at the level of inlets 8 and 9 and at the level of the pumping means. These measurements may be transmitted to the surface through the same transmission means as that used for the remote control.

Valves 32 and 33 may form a single valve with two inlets and one outlet, including a single adapter whose displacement opens one of the gates while it closes the other, and conversely.

The variant according to FIG. 3 is not limited to only one type of pump. Any pump type adapted for being immersed in a well is suitable for the invention.

The present invention is not limited to only two suction inlets. In fact, the means described may be easily transposed by the man skilled in the art into equivalent means adapted to more than two suction inlets with equivalent results.

Figure 4:
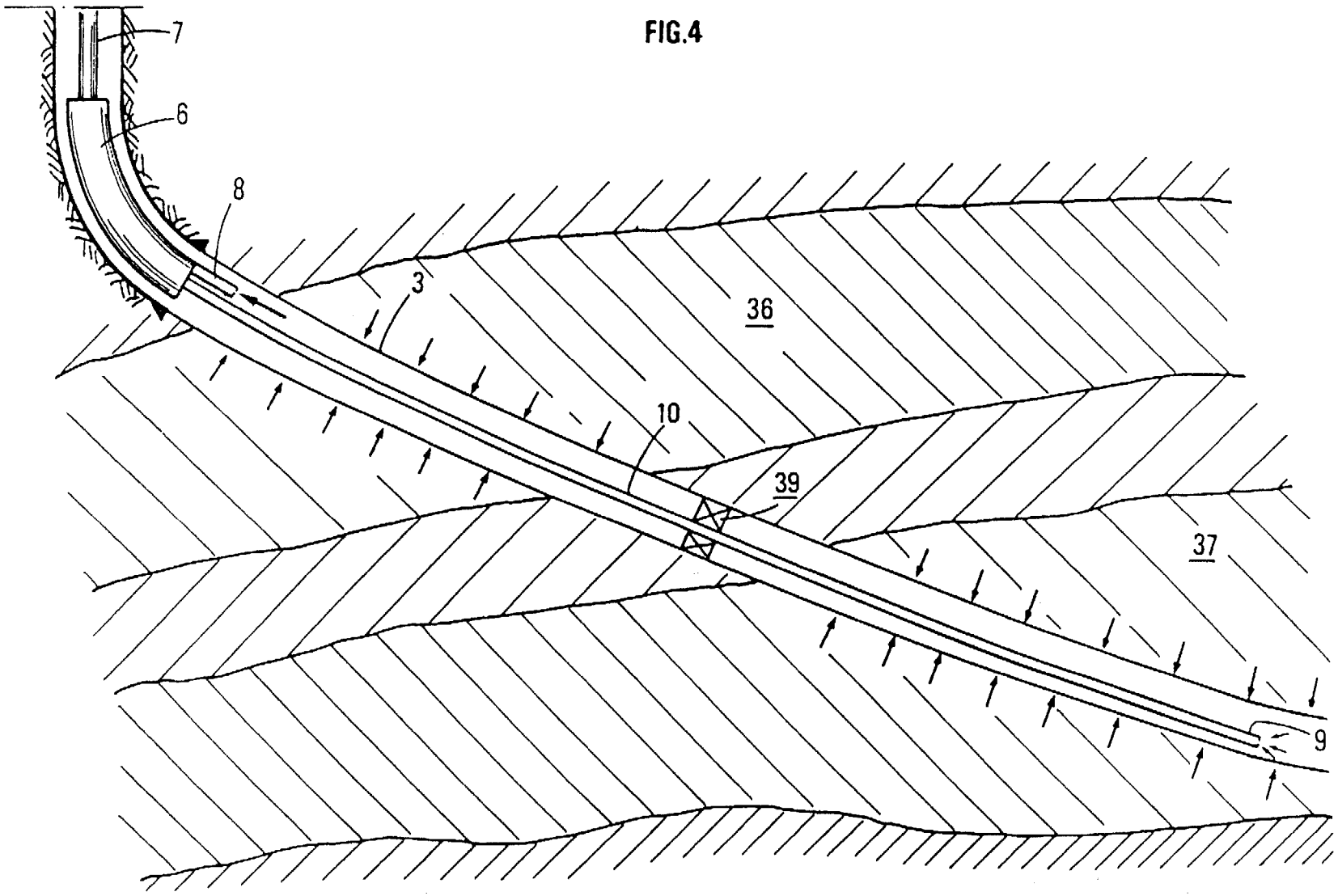
FIG. 4 shows an application variant according to the invention.

FIG. 4 shows an application to a subhorizontal drain hole 3 crossing several producing layers 36 and 37. The inlet hole 8 mainly draws off the effluent coming from layer 36, while inlet 9 draws off the effluent from layer 37. A total or partial seal means 39 connected to extension tube 10 may be located between the two layers so as to improve the specificity of each inlet.

In an equivalent way, the layer developed from the suction inlet which is at the furthest distance from the pumping means may be located at a lower depth with respect to the first layer crossed by drain hole 3. This means that the drain hole is drilled according to a trajectory which goes up towards the surface. Of course, this case may also occur in a single layer.

We claim:

1. A method for pumping effluent from a drain hole having a selected length extending with a horizontal component through an effluent containing formation which drains effluent into the drain hole at zones along the length of the drain hole, the method comprising:

pumping effluent from the drain hole with a pump disposed at least proximate the drain hole;

applying suction selectively from the pump to a first zone in the drain hole distal of the pump to pump effluent from the first zone;

applying suction selectively from the pump to a second zone spaced with respect to the first zone to pump effluent from the second zone;

controlling the application of suction and thus effluent flow rates with respect to the first and second zones from a location above the drain hole.

2. The method of claim 1, wherein the application of suction is controlled by valves disposed between the pump and first and second zones.

3. The method of claim 2 further comprising monitoring conditions in the drain hole from a location above the drain hole.

4. The method of claim 1 further comprising monitoring conditions in the drain hole from a location above the drain hole.

5. The method of claim 1 further including measuring dynamic pressures at the first and second zones and controlling remotely the application of suction to the first and second zones in accordance with the dynamic pressures at the zones.

6. The method of claim 1, wherein the application of suction is controlled by valves disposed between the pump and first and second zones.

7. The method of claim 1, wherein the location above the drain hole is a location substantially at ground surface level.

8. The method of claim 1, wherein the first and second locations from which the effluent is drawn are discrete.

9. The method of claim 1, wherein the effluent is petroleum.

10. the method of claim 1, wherein the second zone is located between the pump and the first zone.

* * * * *